US008899165B2

(12) United States Patent
Puck

(10) Patent No.: US 8,899,165 B2
(45) Date of Patent: Dec. 2, 2014

(54) FOLDING FLOATING VESSEL

(76) Inventor: Benny D. Puck, Manning, IA (US)

( * ) Notice: Subject to any disclaimer, the term of this patent is extended or adjusted under 35 U.S.C. 154(b) by 0 days.

(21) Appl. No.: 13/315,000

(22) Filed: Dec. 8, 2011

(65) Prior Publication Data

US 2013/0145980 A1 Jun. 13, 2013

(51) Int. Cl.
*B63B 1/14* (2006.01)

(52) U.S. Cl.
USPC ..... 114/61.15; 114/61.16; 37/307

(58) Field of Classification Search
USPC ..... 114/61.15, 61.16, 61.1; 37/307
IPC ..... B63B 1/14
See application file for complete search history.

(56) References Cited

U.S. PATENT DOCUMENTS

| | | | | |
|---|---|---|---|---|
| 3,172,134 | A * | 3/1965 | Livingstone | 114/344 |
| 3,541,987 | A * | 11/1970 | Barkley | 114/61.16 |
| 6,564,735 | B1 * | 5/2003 | Jackson | 114/61.1 |
| 6,625,907 | B2 * | 9/2003 | Murray et al. | 37/332 |
| 7,044,815 | B1 * | 5/2006 | Symes et al. | 440/7 |

* cited by examiner

*Primary Examiner* — Stephen Avila
(74) *Attorney, Agent, or Firm* — Brett J. Trout P.C.

(57) ABSTRACT

A foldable floating vessel providing a large surface area and heavy payload capability when deployed into a liquid, such as a manure lagoon. The vessel may be folded for transport using linear actuators to fold two hulls of the vessel from a first position substantially horizontal to a second position substantially vertical. Driving and steering assemblies are provided on a center frame to which the foldable hulls are pivotably connected.

18 Claims, 7 Drawing Sheets

FOLDING FLOATING VESSEL

TECHNICAL FIELD

The present invention relates in general to a floating vessel and, more particularly, to a floating vessel with hulls that fold for transport.

BACKGROUND

Boats may be used for leisure and work related activities. For many such activities, a larger boat is more desirable, especially in situations where it is desired to carry a large payload. While large boats provide several benefits, including greater stability, greater payload and more room, larger boats can be more difficult to transport. The width of large boats makes maneuvering them on a trailer difficult and may prevent the trailered boat from traveling on roads with width restrictions. It would, therefore, be desirable to provide a large boat that may be configured to a narrower width for transport.

It would be particularly desirable to narrow the transport width of boats used to perform activities at worksites. Prior art "working boats" may need to be used at a worksite and moved to another worksite multiple times a day. Accordingly, prior art working boats often sacrifice size, payload and stability for narrower transport dimensions.

One type of boat used at worksites is a floating manure agitator. Livestock produce a large amount of manure. The nitrogen content of manure makes it useful as fertilizer on agricultural fields. While manure is continually produced, it is only needed as fertilizer during certain times of the year. During the times it is being produced and not yet needed, it must be stored. It is also desirable to break down manure prior to application as a fertilizer. One method of storing and breaking down livestock manure is a manure lagoon. Manure lagoons are sloped, fully impermeable pits, fifteen to thirty-five feet deep, and may be several hundred feet across.

Manure from a livestock operation is pumped into a lagoon where anaerobic bacteria digest, liquefy, and convert a portion of the manure to carbon dioxide, methane, ammonia and hydrogen sulfide. The resulting supernatant contains nitrogen and calcium. The resulting solids form a sludge that rests on the bottom of the manure lagoon. The sludge is made up of several biodegradable organic solids, including lignin and cellulose. The sludge also contains high concentrations of phosphorous. After anaerobic bacteria breaks down the manure, the manure is pumped from the lagoon to a tank for transport and then applied to an agricultural field.

To prevent an undesirable buildup of sludge at the bottom of the lagoon, it would be desirable to provide a boat with an agitator to create a slurry by moving solids in sludge into suspension within the supernatant. Providing a boat to agitate the manure would overcome prior art difficulties associated with land based propellers not being able to mix sludge at the center of the lagoon. To adequately move the solids in the sludge into suspension, especially at the center of the lagoon, a large pump and spray nozzle are required. A large pump requires a large motor, which in turn requires a large boat to support the motor, pump and spray assembly. As noted above, while the greater size of the boat facilitates the use of larger equipment to more effectively mix the manure within the lagoon, the wider boat has the additional drawback of being difficult to transport. It would, therefore, be desirable to provide a boat with a larger width when the boat is on the water and a narrower width when the boat is being transported.

The difficulties encountered in the prior art discussed hereinabove are substantially eliminated by the present invention.

SUMMARY OF THE DISCLOSED SUBJECT MATTER

In the preferred embodiment of this invention, a foldable floating vessel is provided with a first hull and a second hull both pivotally coupled to a center spine. A motor and propulsion assembly are provided on the spine, as are linear actuator mounts. A first linear actuator is coupled between the first hull and its respective mount and a second linear actuator is coupled between the second hull and its respective mount. When the linear actuators are at full extension, the hulls are parallel with one another and with the spine, providing a large buoyant surface to support the weight of the motor and propulsion assembly. When it is desired to transport the vessel, the linear actuators are retracted to pivot the exterior sides of the hulls upward toward the spine, thereby decreasing the overall width of the vessel for transport.

BRIEF DESCRIPTION OF THE DRAWINGS

The present invention will now be described, by way of example, with reference to the accompanying drawings in which.

DETAILED DESCRIPTION OF THE DRAWINGS

Figure 1:
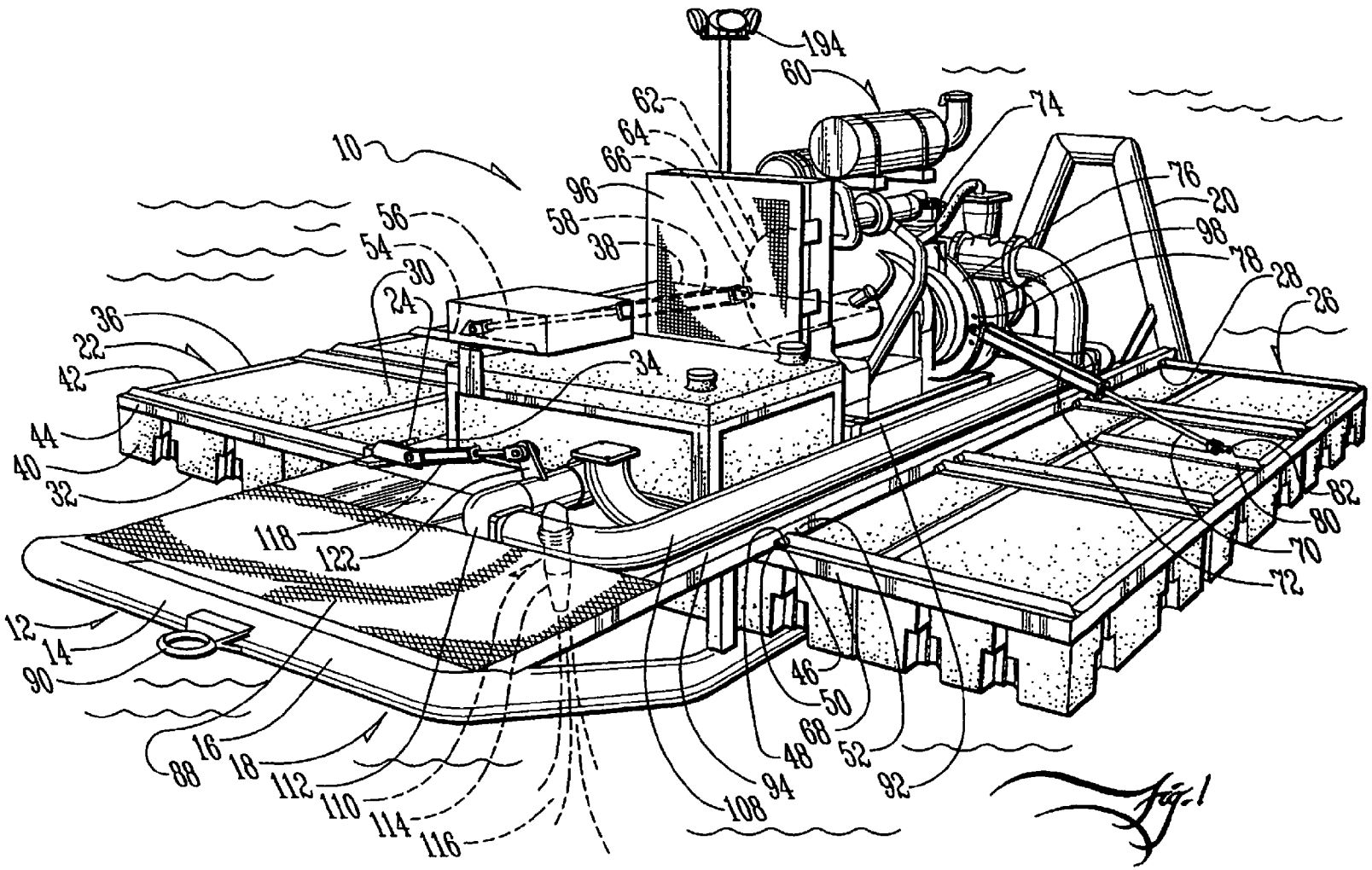
FIG. 1 illustrates a front perspective view of the floating vessel of the present invention shown with the hulls extended.

A foldable floating vessel is shown generally as (10) in FIG. 1. While the vessel (10) may be any desired type of vessel, such as a recreational pontoon boat or a commercial barge, in the preferred embodiment the vessel (10) is a floating fluid agitator (12).

Figure 2:
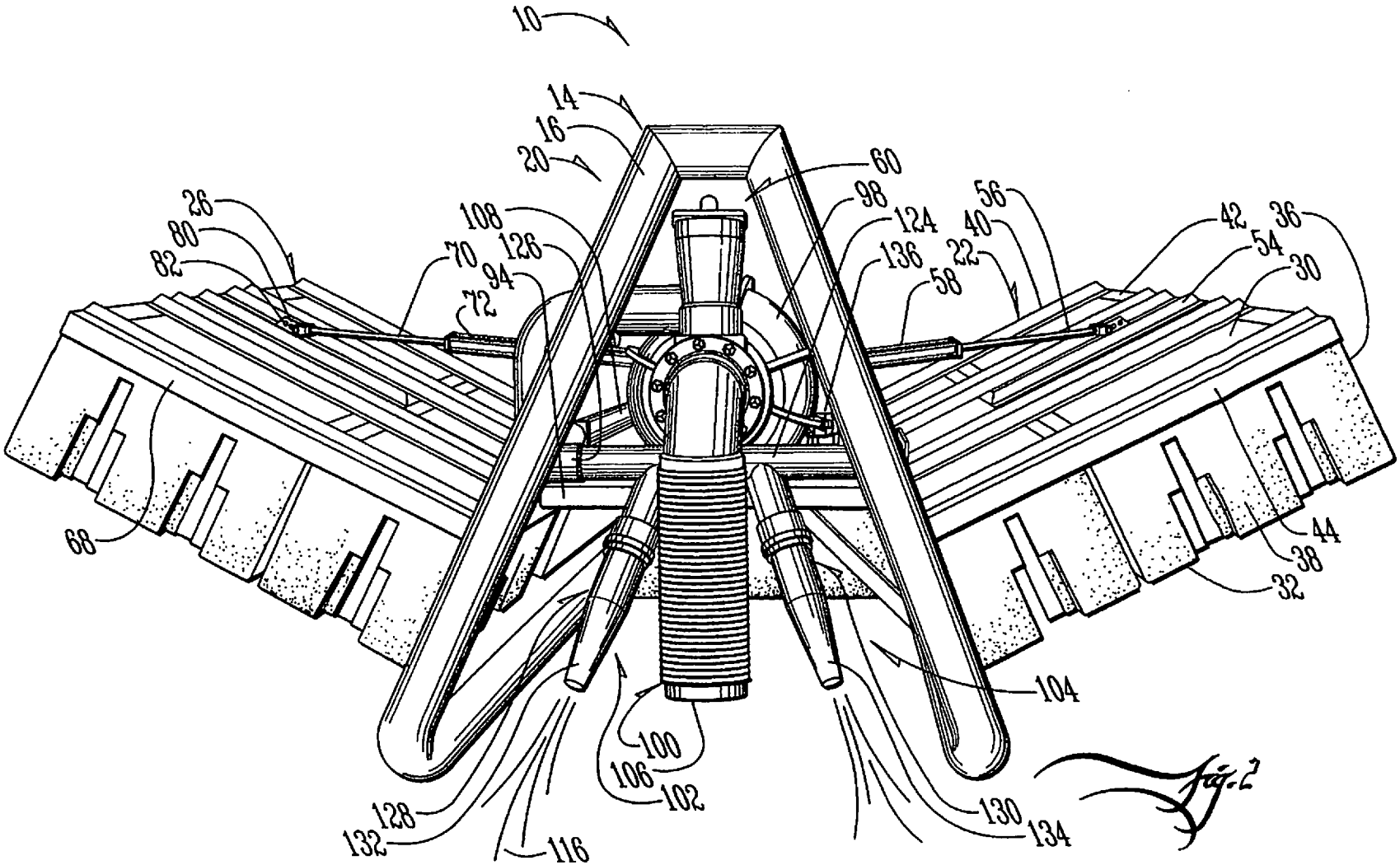
FIG. 2 illustrates a rear elevation of the floating vessel of FIG. 1, shown with the hulls midway between extended and retracted.
Figure 3:
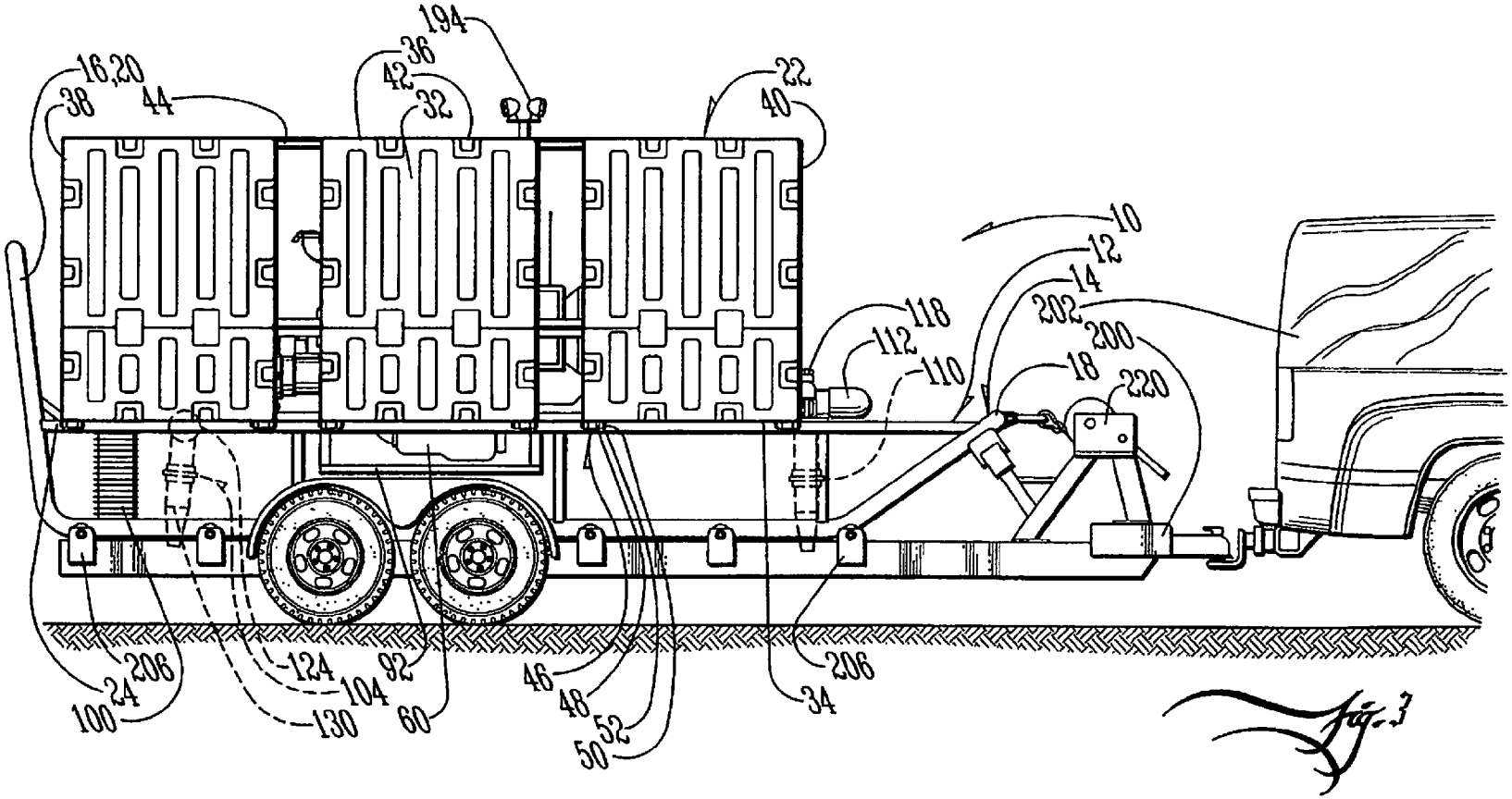
FIG. 3 illustrates a side elevation of the floating vessel of FIG. 1, shown with the hulls retracted and the vessel positioned on a transport trailer.
Figure 6:
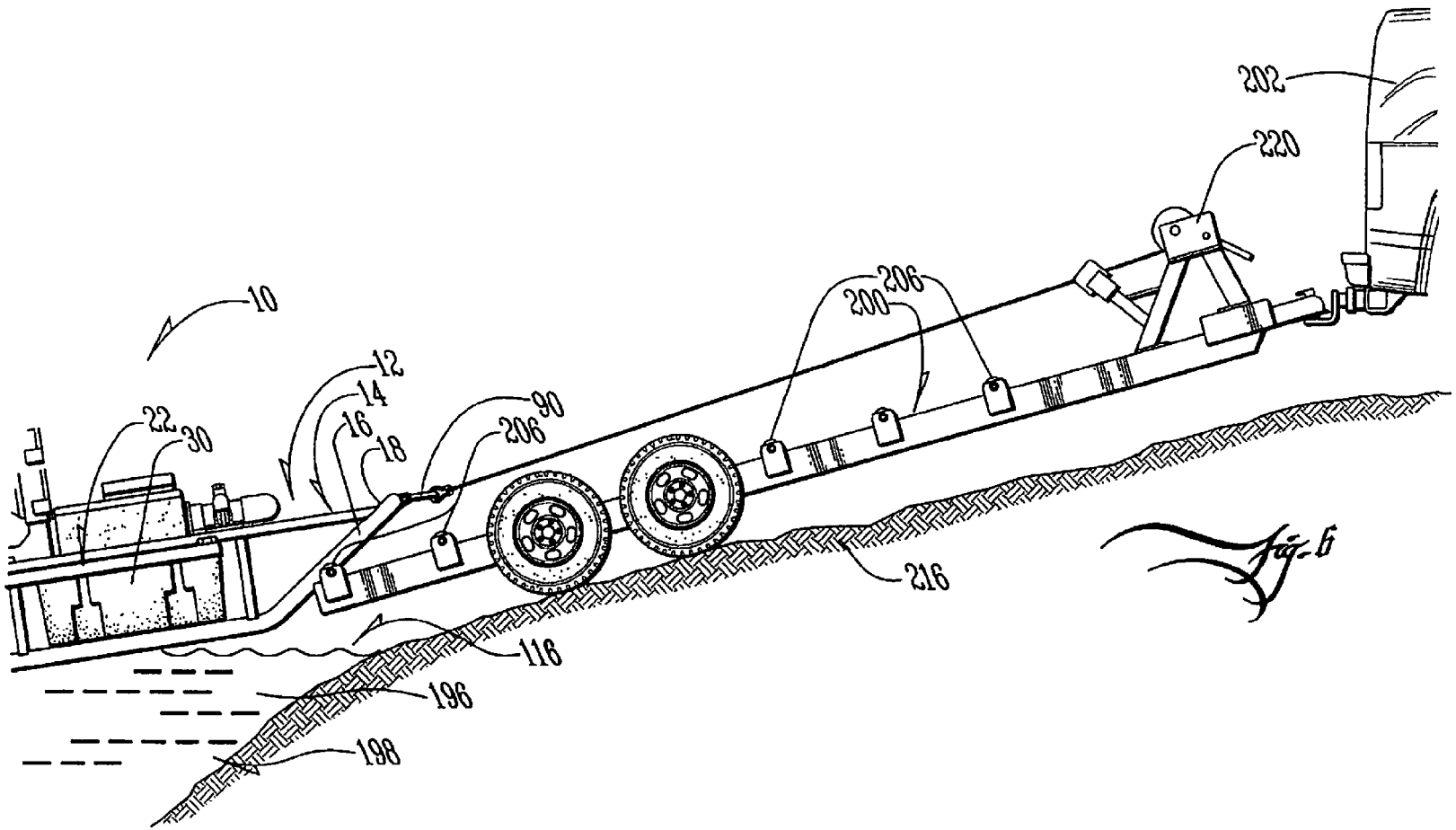
FIG. 6 illustrates a side elevation of the floating vessel of FIG. 1 being launched into a manure lagoon from a transport trailer.

The agitator (12) is provided with a frame (14) preferably constructed of welded tubular steel pipes (16). The frame may be of any suitable dimensions but is preferably provided with a width greater than 0.5 meter and less than 5.0 meters. The agitator (12) may, alternatively, be constructed of any suitable material or may be constructed with a more standard hull, such as those known in the art. The frame is constructed with a bow (18) angled forward and a stern (20) angled upward and toward a center line as shown in FIG. 2. The angled bow (18) facilitates the launch and retrieval of the agitator (12) from a pond or lagoon (198). (FIGS. 1, 2 and 6). The frame (14) acts as a spine to which are pivotally secured a first hull (22) at at least a first pivot point (24) and a second hull (26) at least a second pivot point (28). (FIG. 3).

As the hulls (22) and (26) are substantially mirror images of one another, description will be limited to the first hull (22). The first hull (22) is a rectangular float which, in the preferred embodiment is a 1000 Series Dock component manufactured by Connect-A-Dock, Inc. of Atlantic, Iowa. Pontoons, such as those known in the art, or any suitable floatation device may be used.

Preferably, the first hull (22) is provided with a rectangular top side (30), rectangular bottom side (32), rectangular port side (34), rectangular starboard side (36), rectangular stern (38), and rectangular bow (40). Preferably the vessel (10) has ten to fifty inches of draw, more preferably between fifteen and thirty inches of draw and, most preferably, about twenty-six inches of draw. As shown in FIG. 3, the bow (40) of the hull (22) is not only rectangular, but is preferably substantially perpendicular to the forward direction of travel of the agitator (12). If the vessel (10) is to be used at higher speeds, the bow (40) may be angled as desired.

Provided along the top of the starboard side (36) of the hull (22) is a steel plate (42). The plate reduces damage to the hull (22) if the hull (22) contacts a dock or other obstruction. Secured to the top side (30) of the hull (22) are a plurality of frames (44). The frames (44) may be constructed of any suitable material but are preferably constructed of angled steel secured to the hull (22). Along the port side of each of the frames (44) is provided a hole (not shown) which fits into alignment with a plurality of knuckle assemblies (46) secured to the frame (14). The holes of the frames (44) are positioned in the slots (48) defined by the knuckle assemblies (46) aligned with the holes passing through the knuckle assemblies (46) and pins (50) are passed through the holes in the knuckle assemblies (46) and frames (44) to pivotally secure the hull (22) to the frame (14). The knuckle assemblies (46) and pins (50) may be of any known construction and the pins (50) may be secured to the knuckle assemblies (46) with cotter pins (52) or any suitable securement mechanism.

As shown in FIG. 1, pivotally coupled to a center frame (54) is the arm (56) of a linear actuator (58) which, in the preferred embodiment is a hydraulic cylinder. Secured to the frame (14), either directly or via a motor coupled to the frame, is a linear actuator mount (62) which in the preferred embodiment is a semi-circular steel plate (64), provided with a plurality of holes (66) and welded to the motor (60).

Coupled to the second hull (26) is a plurality of frames (68), one of which is pivotally coupled to the arm (70) of a linear actuator (72). The linear actuator (72) is also pivotally coupled to a linear actuator mount (74) which is a steel plate (76) provided with holes (78) and secured to the frame (14) via the motor (60). The holes (66) and (78) allow for adjustment of the linear actuators (62) and (72) to alternately increase the leverage and speed with which the hulls (22) and (26) are folded upward relative to the frame (14). The arm (56) to which the linear actuator (58) is coupled and the frame (80) to which the second linear actuator (62) is coupled are also provided with holes (82) to allow for adjustment of the linear actuators (58) and (72). The linear actuators (58) and (72) are coupled to a hydraulic pump (84) that, in turn, is coupled to a 12 volt battery (86). (FIGS. 1-3).

A vessel (10) is provided with a deck (88) which is a steel plate welded to the frame (14). Also welded to the frame (14) is a steel ring (90) that allows the vessel (10) to be towed in the water or pulled from the water. As shown in FIG. 3, secured to the frame (14) is a recessed steel cage (92). In the cage is the motor (60). While the motor (60) may be of any desired type, in the preferred embodiment the motor (60) is a John Deere Tier No. 3 diesel engine. Depending on the desired size and efficiency of the agitator (12), the motor (60) is preferably between twenty and two-thousand horsepower, more preferably between fifty and five-hundred horsepower, and most preferably between one hundred fifty and two hundred fifty horsepower.

The cage (92) sits partially below the top (94) of the frame (14) to lower the center of gravity of the vessel (10), while maintaining the motor (60) above the waterline. A radiator (96) and fluid pump (98) are coupled to the motor (60). The fluid pump (98), along with a fluid intake (100), and fluid output (102) form the propulsion assembly (104) of the vessel (10). (FIGS. 1-3). The fluid pump (98) is preferably a slurry pump, such as a Cornell Redi-Prime Centrifugal pump, capable of handling both solids and liquid material.

The fluid pump (98) is preferably designed to move between five hundred and six thousand gallons of material per minute, more preferably between two thousand and five thousand gallons of material per minute and, most preferably, about four thousand gallons of material per minute. The fluid intake (100) is preferably a slurry intake having an opening (106) positioned below the hulls (22) and (26). The fluid intake may be extensible to adjust the positioning of the opening (106) below the hulls (22) ad (26). The fluid intake (100) is constructed to extend about twenty-four inches below the waterline but may be extended or retracted to the desired depth. In the preferred embodiment, the fluid output (102) is a slurry output (104) coupled to the fluid pump (98).

Coupled to the fluid pump (98) by a transport pipe (108) is a first fluid output (110). (FIG. 1). The first fluid output (110) is an angled pipe (112) journaled to the front outlet of the transport pipe (108). Releasably coupled to the angled pipe (112) is a liquid nozzle (114) to increase the velocity of liquid (116) passing through the nozzle (114). If desired, different sizes and configurations of nozzles (114) may be coupled to the angled pipe (112) to adjust the direction and velocity of the liquid (116) exiting through the fluid output (110). Coupled between the angled pipe (112) and the frame (14) is a steering control hydraulic cylinder (118). The hydraulic cylinder (118) is coupled between the frame (14) and an ear (122) secured to the angled pipe (112). The hydraulic cylinder (118) is also coupled to a hydraulic pump (120) that, in turn, is coupled to the 12 volt battery.

As shown in FIG. 2, journaled to the rear outlet of the transport pipe (108) is a pivot pipe (124). (FIG. 2). The pivot pipe (124) is also journaled to a bearing (126) secured to the frame (14). Depending from the pivot pipe (124) are a second fluid output (128) and third fluid output (130). Preferably, the fluid outputs (128) and (130) are angled outward from the centerline of the vessel (10), along which the intake (100) is located.

Figure 7:
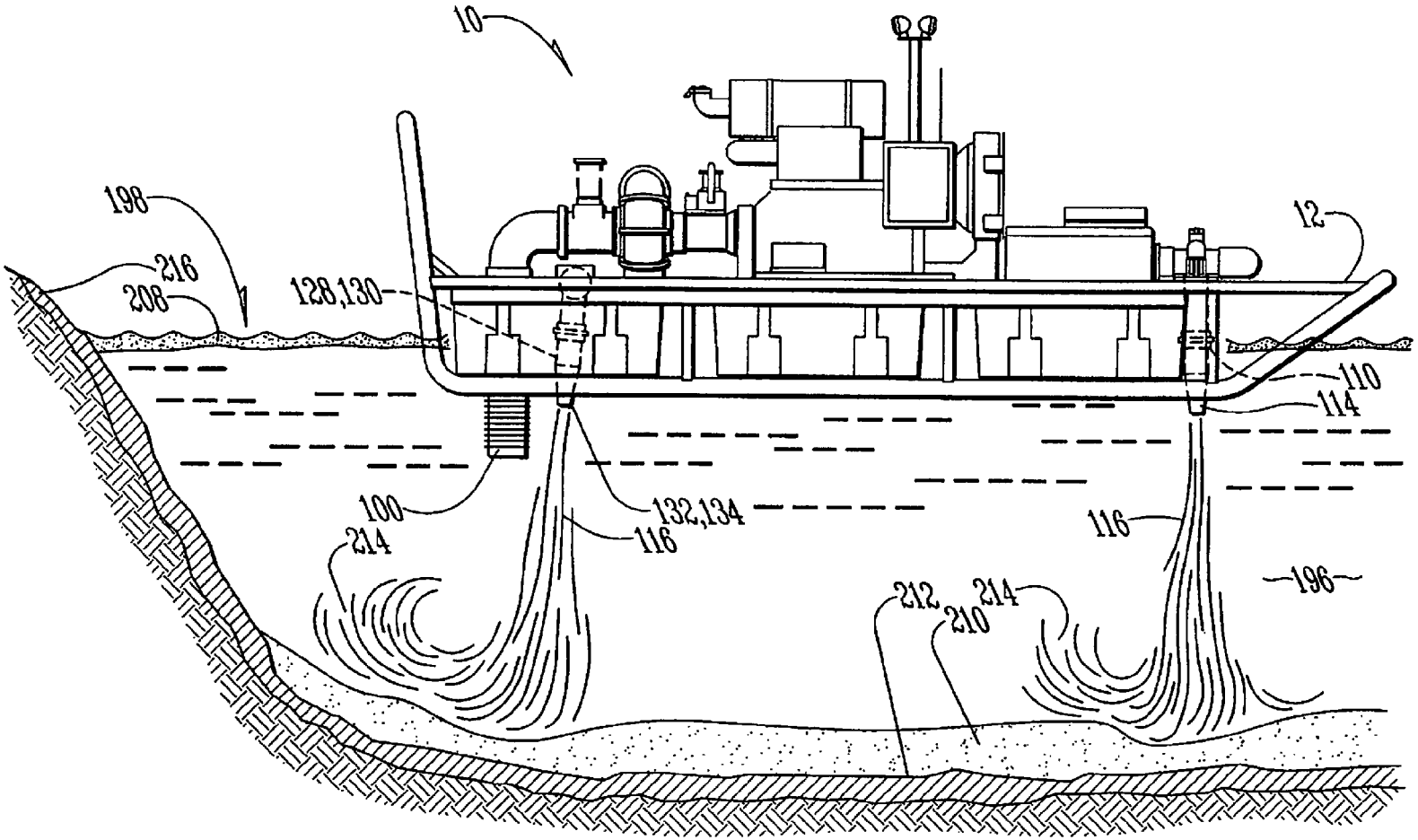
FIG. 7 illustrates a side elevation of the floating vessel of FIG. 1 on a manure lagoon.

Releasably coupled to the second fluid output (128) and the third fluid output (130) are a pair of nozzles (132) and (134), oriented and configured to direct the liquid (116) as desired to increase the velocity with which the fluid (116) exits the nozzles (132) and (134). (FIGS. 2 and 7). Coupled between the pivot pipe (124) and the frame (14) is a hydraulic cylinder (136) that rotates the pivot pipe (124) to direct the second fluid output (128) and third fluid output (130) preferably between ninety degrees aft and ninety degrees stern from a downward position, more preferably between sixty degrees aft and sixty degrees stern and, most preferably about forty-five degrees aft and forty-five degrees stern.

Figure 5:
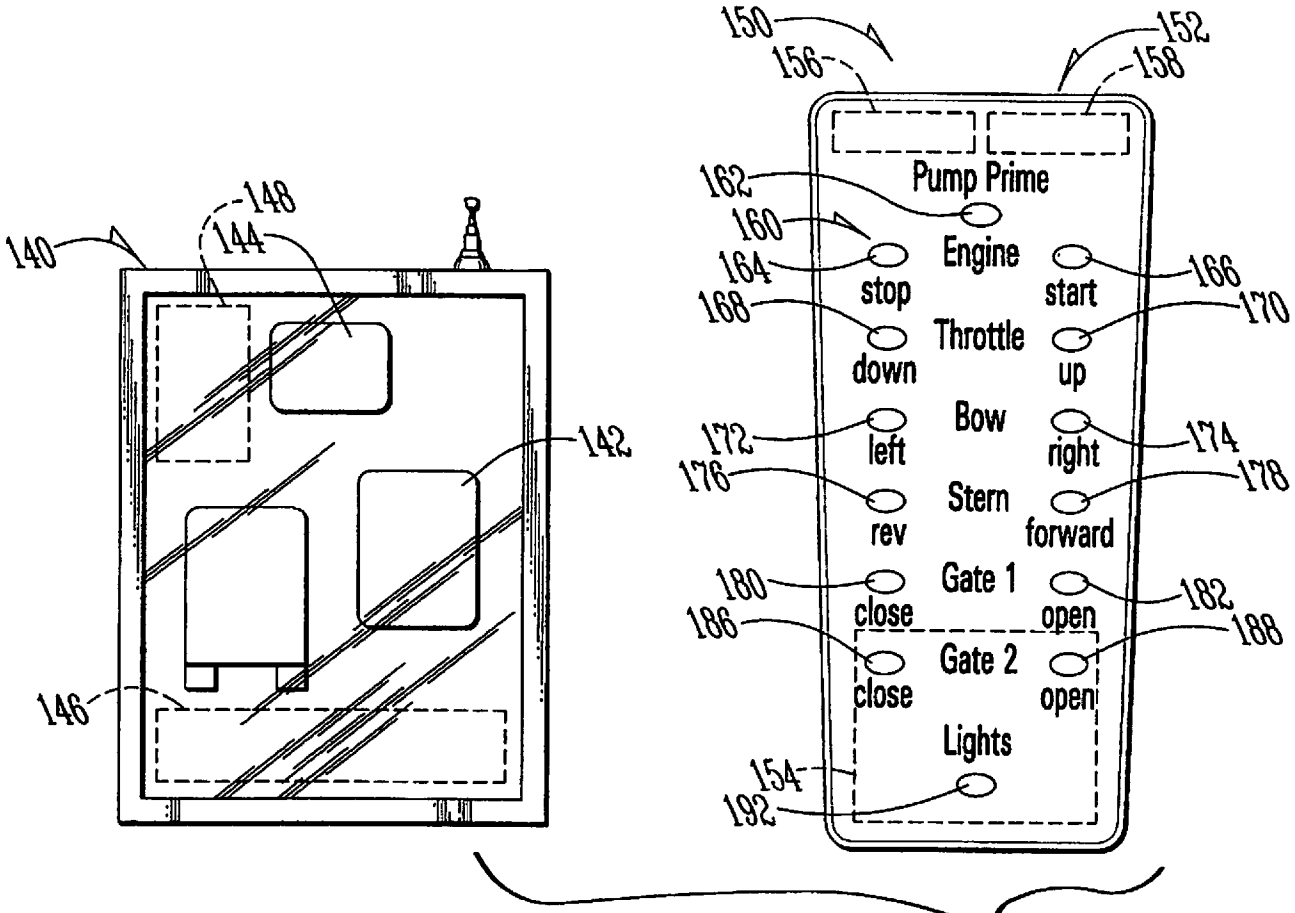
FIG. 5 illustrates a block diagram in partial cutaway of the control panel and remote control of the floating vessel of FIG. 1.

As shown in FIG. 1, the hydraulic cylinder (136) is coupled to the hydraulic pump (84). The hydraulic pump (84) is coupled to a control manifold (138) that is electronically coupled to a control panel (140) provided with a central processing unit (142) and a global positioning system (144). Also coupled to the control panel (140) are a wireless receiver (146) and wireless transmitter (148), that allow the control panel (140) to operate as a wireless remote control, actuated by a remote control system (150). (FIGS. 1 and 5). The remote control system (150) may be a portable computer (not shown), or simply a handset (152), provided with a battery (154), a wireless transmitter (156) and a wireless receiver (158). The remote control system (150) may be provided with one or more joysticks, touchscreens, keyboards or other input devices known in the art (not shown), to allow the remote control system (150) to accept commands. In the preferred embodiment, the remote control system (150) is provided with a plurality of buttons (160) as shown in FIG. 5. The remote control system (150) is provided with a pump prime button (162). The prime pump button (162) signals the control panel (140) to circulate fluid within the fluid pump (98) to prime the pump (98) prior to use.

The remote control system (150) also includes an engine stop button (164), start button (166), a throttle down button (168) and throttle up button (170). To steer the vessel (10) the remote control system (150) is provided with a bow left button (172) and bow right button (174). The bow left button (172) causes the steering control hydraulic cylinder (118) to extend, thereby directing the nozzle (114) to the starboard side (36) and driving the vessel (10) to the port. The remote control system (150) is also provided with a bow right button (174) to retract the hydraulic cylinder (118) and steer the vessel (10) to starboard. The remote control system (150) is provided with a reverse button (176) which causes the hydraulic cylinder (136) to extend, thereby forcing the pivot pipe (124) to direct the fluid outputs (128) and (130) toward the bow of the vessel (10), thereby driving the vessel (10) rearward. Similarly, a forward button (178) causes the hydraulic cylinder (136) to retract and drive the vessel (10) forward.

If desired, the remote control system (150) may be provided with a first gate close button (180) that closes a valve (184) positioned between the fluid intake (100) and forward nozzle (114). A gate open button (182) is also provided to open the valve (184). Similarly, a close gate button (186) and open gate button (188) are provided to open and close a valve (190) provided between the fluid intake (100) and the nozzles (132) and (134). The gate buttons (180), (182), (186) and (188) allow a user to selectively supply fluid through one, two or three of the nozzles (114), (132) and (134) as is desired, to appropriately agitate the liquid (116) within which the vessel (10) is floating. The remote control system (150) is also provided with a button (192) for lights (194) to actuate light (194) provided on the vessel (10) if it is desired to use the vessel (10) in circumstances where additional lighting is desired. The remote control system (150) may be configured to receive feedback from the control panel (140), such as system status, latitude, longitude and height coordinates.

When it is desired to place the vessel (10) on a body of liquid (116), such as manure slurry (196), the vessel is preferably transported to a manure lagoon (198) using a trailer (200) and a pulling vehicle (202). (FIGS. 2, 3 and 6). The linear actuators (58) and (72) are then actuated either via a switch (204) on the vessel (10) or a switch (not shown) on the remote control system (150) to rotate the first hull (22) and second hull (26) from the orientation shown in FIG. 3 to the orientation shown in FIG. 4, and finally to the orientation shown in FIG. 1. While the hulls (22) and (26) may be moved from any first orientation to any second orientation, it is preferable that the hulls (22) and (26) rotate from a first position wherein a majority of the hulls (22) and (26) are above the pivot points (24) and (28) of the hulls (22) and (26) to a second position wherein a majority of the hulls (22) and (26) are located below the pivot points (24) and (28).

When the hulls (22) and (26) are in the desired position, the pulling vehicle (202) is used to back the trailer (200) into the lagoon (198). (FIGS. 1 and 6). Depending upon the angle of the trailer (200), the vessel (10) may roll off the trailer (200) by the force of gravity or may be manually pushed from the trailer (200) into the lagoon (198). If desired, the trailer (200) may be fitted with a plurality of rollers (206) to facilitate the removal of the vessel (10) from the trailer (200).

Once the vessel (10) is floating in the lagoon (198), the remote control system (150) is used to activate the vessel (10) to cause the pump (84) to draw manure slurry (196) into the fluid intake (100) and out the nozzles (114), (132) and (134). (FIGS. 1, 2, 5 and 6). The vessel (10) may be driven over the manure lagoon (198) to break up the crust (208) and force the slurry (196) downward into the lagoon (198) with sufficient force to cause the sludge (210) at the bottom (212) of the lagoon (198) into suspension with the slurry (196). (FIG. 7). Preferably, the force of the slurry (196) generates vortices (214) near the bottom (212) of the lagoon (198) to cause additional mixing between the slurry (196) and the sludge (210).

Figure 4:
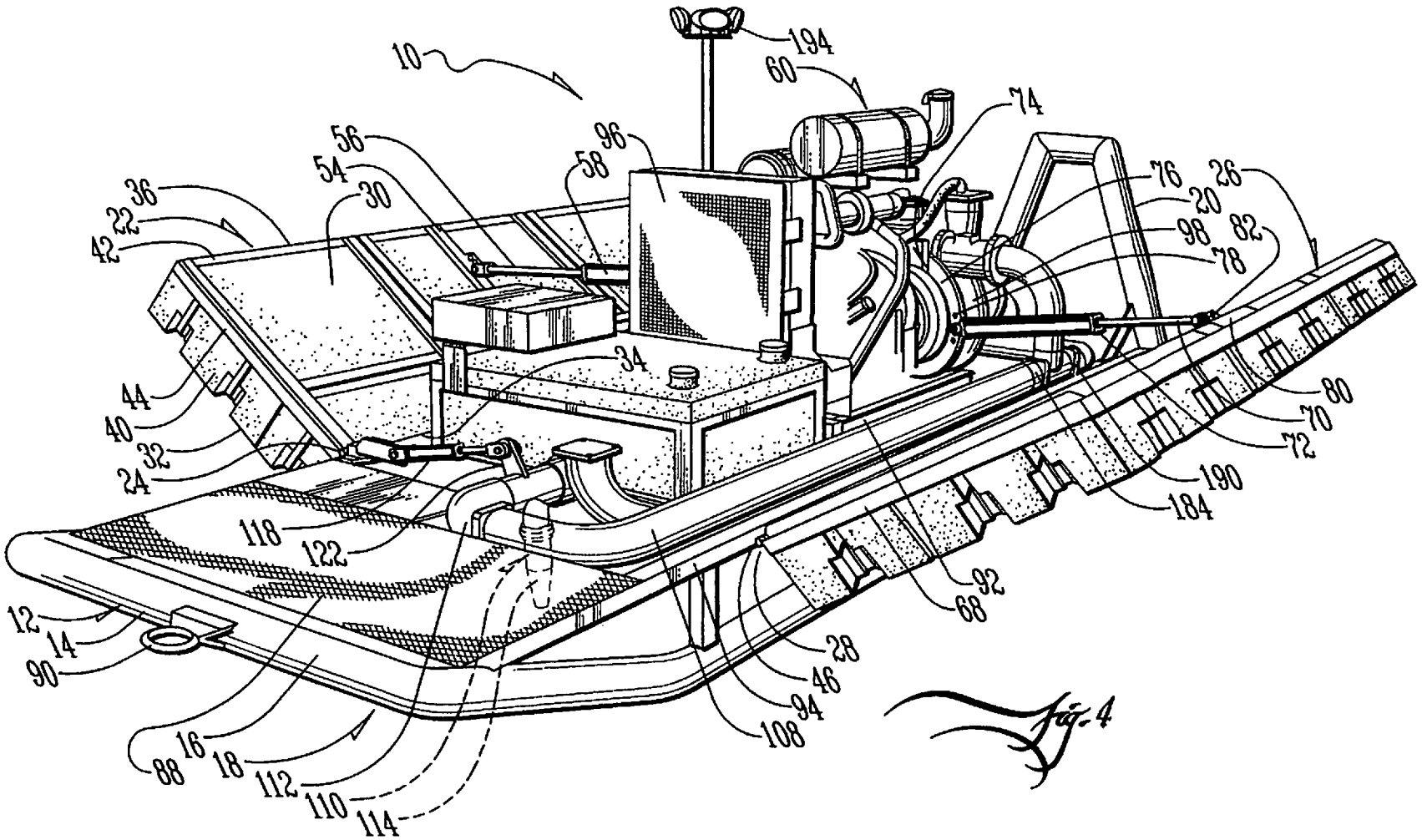
FIG. 4 illustrates a front perspective view of the floating vessel of FIG. 1, shown with the hulls midway between extended and retracted.

When it is desired to remove the vessel (10) from the lagoon (198), the vessel (10) is driven toward the shore (216) of the lagoon (198) where the trailer (200) has been positioned. A winch (220) coupled to either the trailer (200) or pulling vehicle (202) is then used to pull the vessel (10) onto the trailer (200). Alternatively, the vessel (10) may be moved onto the trailer (200) in any desired manner. Preferably, the vessel (10) is then rinsed off and the linear actuators (58) and (72) are retracted to move the hulls (22) and (26) from the second position wherein a majority of the hulls (22) and (26) are below pivot points (24) and (28) to the first position where a majority of the hulls (22) and (26) are above the pivot points (24) and (28). (FIGS. 1, 4 and 6). Once the hulls (22) and (26) have been retracted, the vessel (10) is secured to the trailer (200) in a manner such as those known in the art, and the pulling vehicle (202) may be used to transport the trailer (200) and vessel (10) to another location as desired.

Although the invention has been described with respect to a preferred embodiment thereof, it is to be understood that it is not to be so limited since changes and modifications can be made therein which are within the full, intended scope of this invention as defined by the appended claims.

What is claimed is:

1. A foldable floating vessel comprising:

(a) a spine;

(b) a first hull pivotably coupled to the spine;

(c) a second hull pivotably coupled to the spine;

(d) a motor coupled to the spine;

(e) a propulsion assembly coupled to the motor, wherein the propulsion assembly comprises:

(i) a slurry pump coupled to the motor;

(ii) a slurry intake coupled to the slurry pump; and (iii) a slurry output coupled to the slurry pump, (f) a steering assembly coupled to the slurry output (g) a linear actuator mount coupled to the spine;

(h) a first linear actuator coupled to the first hull and to the first linear actuator mount;

(i) a second linear actuator mount coupled to the spine;

(j) a second linear actuator coupled to the second hull and to the linear actuator mount;

(k) wherein the first hull is coupled to the spine at a pivot point;

(l) wherein the first linear actuator is of construction and orientation capable of rotating the first hull from a first position wherein a majority of the first hull is below the pivot point to a second position wherein a majority of the first hull is above the pivot point.

2. The foldable floating vessel of claim 1, wherein the second hull is coupled to the spine at a supplemental pivot point, wherein the second linear actuator is of a construction and orientation capable of rotating the second half from a first position, wherein a majority of the second hull is below the supplemental pivot point to a second position, and wherein a majority of the second hull is above the supplemental pivot point.

3. The foldable floating vessel of claim 2, wherein the first linear actuator and the second linear actuator are of a construction and orientation capable of rotating the first hull and the second hull at least ninety degrees relative to one another.

4. The foldable floating vessel of claim 1, wherein the first linear actuator and the second linear actuator are of a construction and orientation capable of rotating the first hull and the second hull at least ninety degrees relative to one another.

5. The foldable floating vessel of claim 1, wherein the propulsion assembly comprises:

(a) a fluid intake assembly defining an opening positioned below the first hull;

(b) a fluid pump coupled to the fluid intake and to the motor; and (c) a fluid output assembly coupled to the fluid pump and defining an opening positioned below the first hull.

6. The foldable floating vessel of claim 1, wherein the bow of the first hull is substantially perpendicular to the forward direction of travel.

7. The foldable floating vessel of claim 1, wherein the first hull comprises a float, a frame secured to the float, and wherein the first linear actuator is coupled to the frame.

8. The foldable floating vessel of claim 7, wherein the floatation comprises:

(a) a rectangular topside;

(b) a rectangular bottom side;

(c) a rectangular port side;

(d) a rectangular starboard side;

(e) a rectangular bow; and (f) a rectangular stern.

9. The foldable floating vessel of claim 1, further comprising a wireless remote control coupled to the steering assembly.

10. A foldable floating vessel comprising:

(a) a spine;

(b) a first hull pivotably coupled to the spine at a first pivot point in a manner that allows the first hull to pivot from a first position, where a majority of the first hull is below the first pivot point, to a second position, wherein a majority of the first hull is above the pivot point; but does not allow the first hull to pivot to a third position wherein the first hull is directed substantially straight downward;

(c) a second hull coupled to the spine at a second pivot point in a manner that allows the second hull to pivot from a first position, where a majority of the second hull is below the first pivot point, to a second position, wherein a majority of the second hull is above the pivot point;

(d) a fluid intake assembly positioned at least partially below the first hull;

(e) a fluid pump assembly coupled to the fluid intake and to the spine;

(f) a fluid output assembly coupled to the fluid pump assembly and positioned at least partially below the first hull.

11. The foldable floating vessel of claim 10, further comprising a steering assembly coupled to the fluid output assembly.

12. The foldable floating vessel of claim 11, wherein the first hull comprises (a) a rectangular topside;

(b) a rectangular bottom side;

(c) a rectangular port side;

(d) a rectangular starboard side;

(e) a rectangular bow; and (f) a rectangular stern.

13. The foldable floating vessel of claim 10, wherein the spine is more than one-half meter wide.

14. The foldable floating vessel of claim 10, wherein the spine is less than five meters wide.

15. The foldable floating vessel of claim 10, further comprising:

(a) a first mount coupled to the spine;

(b) a first linear actuator coupled to the first hull;

(c) a second mount coupled to the spine; and (d) a second linear actuator coupled to the second hull and to the second mount.

16. A floating slurry agitator comprising:

(a) a spine;

(b) a first hull pivotably coupled to the spine at a first pivot point in a manner that allows the first hull to pivot from a first position, where a majority of the first hull is below the first pivot point, to a second position, wherein a majority of the first hull is above the pivot point;

(c) a second hull coupled to the spine at a second pivot point in a manner that allows the second hull to pivot from a first position, where a majority of the second hull is below the first pivot point, to a second position, wherein a majority of the second hull is above the pivot point;

(d) a slurry intake assembly positioned at least partially below the first hull;

(e) a slurry pump assembly coupled to the slurry intake and to the spine;

(f) a slurry output assembly coupled to the slurry pump assembly and positioned at least partially below the first hull; and (g) a steering assembly coupled to the slurry output assembly.

17. The floating fluid agitator of claim 16, further comprising:

(a) a first mount coupled to the spine;

(b) a first linear actuator coupled to the first hull;

(c) a second mount coupled to the spine; and (d) a second linear actuator coupled to the second hull and to the second mount.

18. The floating fluid agitator of claim 16, further comprising:

(a) a rectangular topside (b) a rectangular bottom side;

(c) a rectangular port side;

(d) a rectangular starboard side;

(e) a rectangular bow; and (f) a rectangular stern.

* * * * *